US006877838B2

(12) United States Patent
Elgee

(10) Patent No.: US 6,877,838 B2
(45) Date of Patent: Apr. 12, 2005

(54) DETECTION OF IN-FLIGHT POSITIONS OF INK DROPLETS

(75) Inventor: Steven B. Elgee, Portland, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 8 days.

(21) Appl. No.: 10/325,300

(22) Filed: Dec. 20, 2002

(65) Prior Publication Data

US 2004/0119779 A1 Jun. 24, 2004

(51) Int. Cl.[7] ..... B41J 2/15
(52) U.S. Cl. ..... 347/40; 347/12; 347/19
(58) Field of Search ..... 347/19, 43, 40, 347/12, 15, 16, 37, 235, 130, 134, 225, 229, 233, 238, 241

(56) References Cited

U.S. PATENT DOCUMENTS 6,243,123 B1 * 6/2001 Tanimoto et al. ..... 347/235
6,299,275 B1 10/2001 Elgee
6,315,383 B1 11/2001 Sarmast et al.
6,328,412 B1 12/2001 Taylor et al.
6,378,975 B1 4/2002 Elgee et al.
6,450,608 B2 9/2002 Sarmast et al.
6,609,777 B2 * 8/2003 Endo ..... 347/19

OTHER PUBLICATIONS

Co–pending Hewlett–Packard Company U.S. Appl. No. 09/906,368, filed Jul. 16, 2001, entitled "Methods and Systems for Detecting and Determining Trajectories of Ink Droplets".

Co–pending Hewlett–Packard Company U.S. Appl. No. 09/915,072, filed Jul. 25, 2001, entitled "Method and Apparatus for Detecting Printer Service Station Capacity".

Co–pending Hewlett–Packard Company U.S. Appl. No. 09/906,008, file Jul. 25, 2001, entitled "Ink Drop Detector Configurations".

* cited by examiner

*Primary Examiner*—Lamson Nguyen

(57) ABSTRACT

A printing device, including an ink delivery system configured to selectively fire ink droplets from an array of nozzles onto media, the array being disposed substantially parallel to an axis, and a detection mechanism, the detection mechanism being configured to detect in-flight positions of the ink droplets relative to the axis.

35 Claims, 4 Drawing Sheets

DETECTION OF IN-FLIGHT POSITIONS OF INK DROPLETS

BACKGROUND

Inkjet printing devices generate printed text and images by firing ink droplets at print media. Generally, a movable printhead carries an array of nozzles that fire the ink droplets on command from selected nozzles within the array. The quality of the resulting printed output can depend on the ability of the nozzles to fire droplets of consistent size along defined, reproducible trajectories to the print media.

Individual nozzles within the array may malfunction during their use. For example, during and after printing operations, ink residues tend to accumulate within and around nozzle orifices. These residues may prevent nozzle firing, may cause nozzles to fire droplets along undesired trajectories, and/or may cause droplets to have inconsistent sizes. Accordingly, printheads and their nozzles should be serviced to avoid malfunctioning that degrades printing device performance.

Inkjet printing devices may include a structure, termed a service station, for performing maintenance operations that reduce problems with printhead function, specifically nozzle firing. The service station may include and/or accommodates capping, wiping, and spitting operations. Capping operations hermetically seal nozzles between print jobs to reduce ink evaporation from nozzles. By contrast, wiping and spitting operations may be used both between and within print jobs to wipe away, eject, and/or dissolve ink residues, to reduce the incidence and severity of nozzle malfunctioning.

One or more of these maintenance operations may be initiated by positioning a printhead in a service portion of a printing device, and then moving an appropriate functional region of the service station to the printhead. Accordingly, the service station may be mounted on a movable sled that reciprocates to position the appropriate functional regions of the service station adjacent to, or in contact with, the printhead. For example, the service station may include a wiper mechanism having wipers that are pulled across the surface of a stationary printhead to remove accumulated residue. However, implementation of the wiper mechanism and other service station operations may reduce printing throughput and also may reduce printhead longevity. Therefore, inkjet printing devices may include detection mechanisms to measure the fidelity of ink droplet delivery, in order to coordinate selective implementation of service station mechanisms or operations. Such detection mechanisms also may be useful for defining corrective firing algorithms, for example, when malfunctioning nozzles cannot be serviced effectively.

Detection mechanisms for measuring droplet trajectories in inkjet printing devices may use contact between ink droplets and a substrate, such as a detector or print media, to define ink droplet positions and thus measure trajectories. Mechanisms based on contact may require that the substrate be cleaned regularly to remove deposited ink. Such cleaning may be time-consuming and may damage the substrate, for example, when a detector acts as the substrate. Alternatively, the substrate may be replaced after its use by the detection mechanism. However, replacing the substrate is wasteful and requires the substrate to be replenished.

SUMMARY

A printing device, including an ink delivery system configured to selectively fire ink droplets from an array of nozzles onto media, the array being disposed substantially parallel to an axis, and a detection mechanism, the detection mechanism being configured to detect in-flight positions of the ink droplets relative to the axis.

DETAILED DESCRIPTION

Apparatus and methods are provided for measuring in-flight positions of ink droplets in an inkjet printing device along an axis, such as an axis defined by an array of nozzles that fire the ink droplets. The apparatus includes a detection mechanism, such as an optical mechanism, configured to detect droplet positions along the axis. The detection mechanism may be dimensioned to detect all or only a subset of droplets fired from the array while the mechanism is stationary. When dimensioned to detect a subset, the detection mechanism may be movable along the axis to detect other subsets fired from the array. The axis may be aligned with a media-positioning axis (or "paper axis"), along which print media and a service station may be moved. Accordingly, movement of the detection mechanism may be coupled to movement of the service station, for example, by mounting the detection mechanism on the service station. Alternatively, movement of the detection mechanism may be uncoupled from movement of the service station.

The detection mechanisms described herein may be configured to measure droplet trajectories in various ways. In some embodiments, the detection mechanisms may measure in-flight trajectories using plural sensor units, arrayed generally parallel to the nozzle array. Such sensor units may detect droplet positions relative to the printing device and/or relative to other fired ink droplets. Alternatively, or in addition, in-flight trajectories may be measured along two orthogonal axes, the paper axis and a scan axis, along which the nozzle array reciprocates. Positions along these two axes may be detected by two spaced sets of sensor units, or a single, shared set of sensor units.

Figure 1:
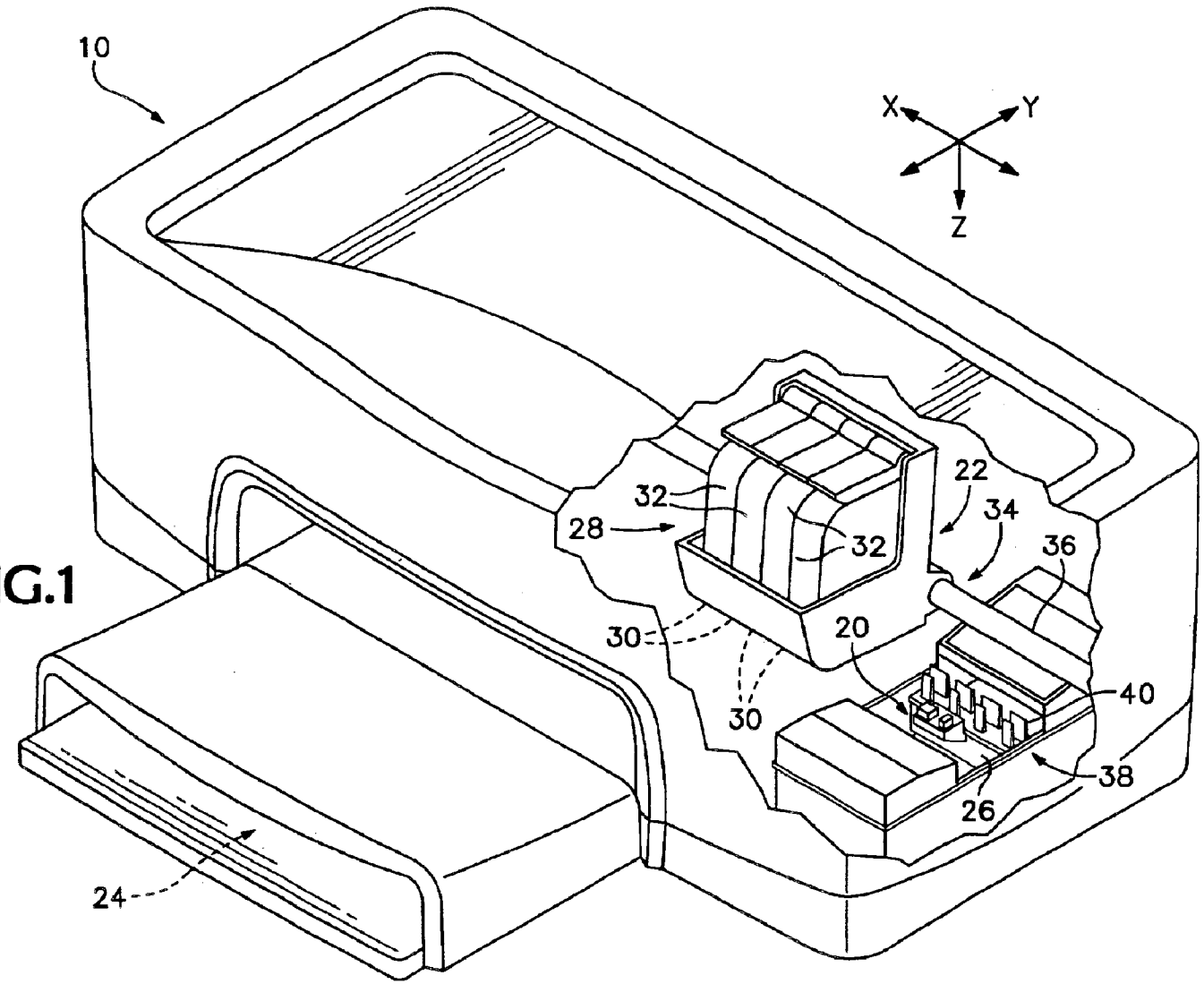
FIG. 1 is a perspective view of an inkjet printing device with a region of the cover removed to reveal a service station carrying a detection mechanism for measuring in-flight ink droplet trajectories, in accordance with an embodiment of the present invention.

FIG. 1 shows an inkjet printing device 10 that includes an embodiment of a detection mechanism 20 for detecting in-flight positions of ink droplets along an axis. In-flight positions may be used to determine or infer trajectories of the fired ink droplets. Inability to detect an in-flight position for an ink droplet suggests that a corresponding nozzle may be clogged or otherwise malfunctioning. Device 10 has an ink delivery system 22, a media-positioning mechanism 24, and a service station 26.

Ink delivery system 22 may be configured to fire ink droplets along the z-axis (or firing axis), at positions along two orthogonal axes of printing device 10. Positions along the y-axis (or paper axis) are determined by selectively firing ink droplets from ink application mechanism 28. By contrast, positions along the x-axis (or scan axis) are determined by reciprocation of ink application mechanism 30 (or portions thereof) on this axis.

Ink application mechanism 28 may include one or more printheads 30, each carrying one, typically two, or more arrays of nozzles. These arrays are generally linear and typically are mounted on mechanism 28 so that the arrays are substantially aligned with the y-axis. Ink droplets are selectively expelled (fired) from individual nozzles within each array to define distinct droplet trajectories along the z-axis, as described below. Ink application mechanism 28 also may include one or plural ink supplies, such as cartridges 32, upon which printheads 30 are mounted. Each of cartridges 32 may carry a different color of ink, such as black, cyan, magenta, or yellow, to one of printheads 30. Alternatively, ink delivery system 28 may receive ink from ink supplies that are flexibly positioned relative to printheads 30, for example, "off-axis" supplies that are stationary relative to device 10.

Firing ink droplets at positions disposed along the x-axis is determined by a scanning mechanism 34. Scanning mechanism may include a carriage rod 36 upon which ink application mechanism 28 reciprocates and is definably positioned (generally along the x-axis).

Media-positioning mechanism 24 typically moves print media parallel to the y-axis (and the nozzle arrays), through an ink delivery window (not shown). The ink delivery window has an area determined by the length of the nozzle arrays, measured along the y-axis, and the extent of movement of the scanning mechanism along the x-axis. Accordingly, adjacent segments of the print media may be successively positioned within the ink delivery window by mechanism 24 to print sequentially in contiguous or overlapping swaths on the media.

Service station 26 may be positioned laterally within device 10. This lateral position generally overlaps the ink delivery window, but not a print media path determined by media-positioning mechanism 24. Accordingly, printheads 30 may be serviced by service station 26 through movement of ink application mechanism 28 to a position adjacent the print media path and over the service station. Once the printheads are suitably positioned for service, service station operations on one or more aspects of ink delivery system 22 may be performed by individual mechanisms within station 26, such as wiper mechanism 38. Such individual mechanisms may be accessed and implemented by movement of service station 26 (or components thereof) on a sled, generally along the y-axis. For example, wipers 40 may be rubbed across printheads 30 by this service station movement. Any other suitable mechanisms or structures also may be included in service station 26, such as a capping mechanism, a spittoon, a wiper cleaning mechanism, and so on. For the purposes of this description, the term service station refers to portions of the service station that are movable, generally along the y-axis.

Figure 2:
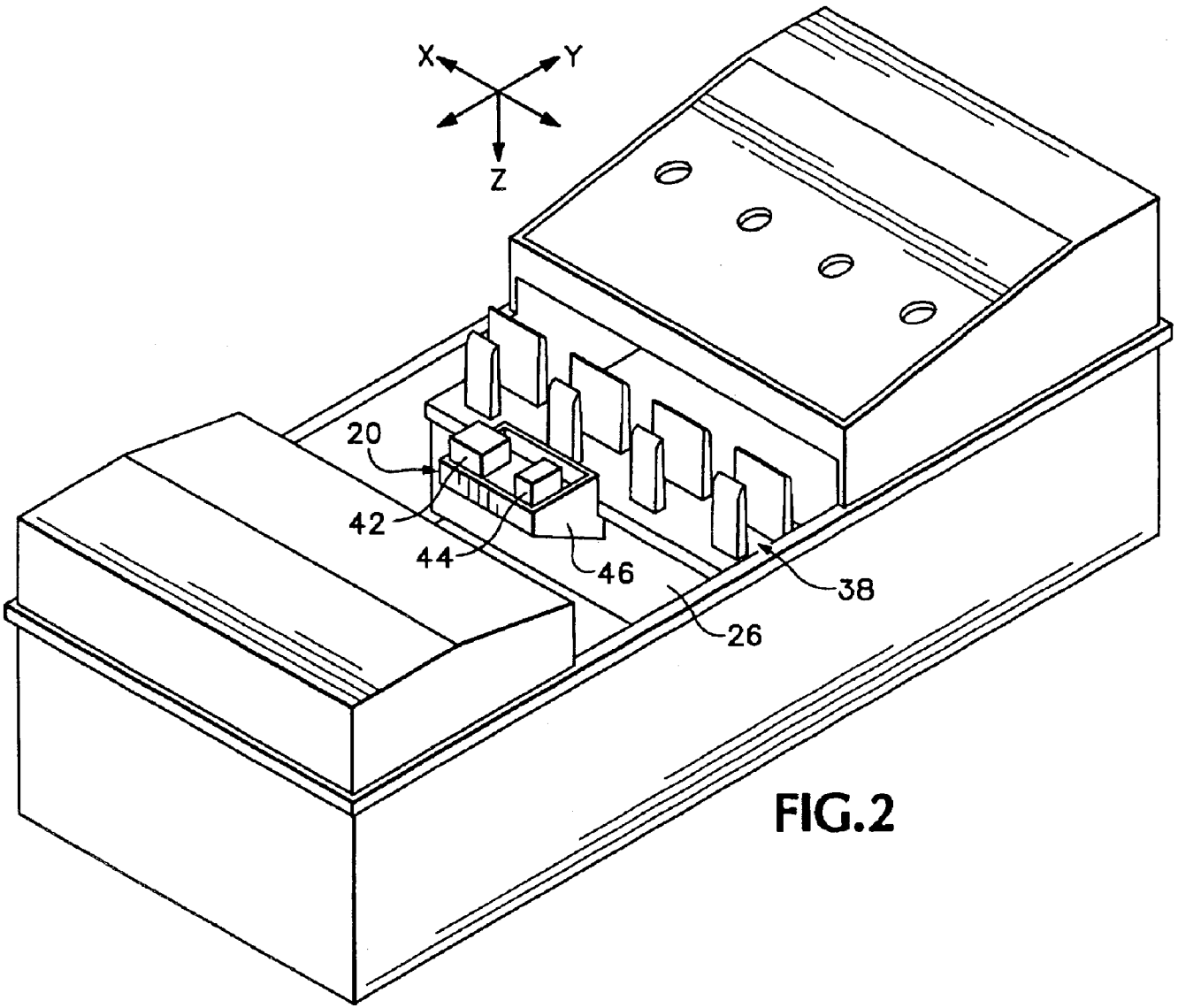
FIG. 2 is a perspective view of the service station of FIG. 1, showing the detection mechanism in more detail.

FIG. 2 shows detection mechanism 20 in more detail. Detection mechanism 20 includes an emitter 42 and a detector 44. Emitter 42 may act as a source of electromagnetic energy. Such electromagnetic energy may be ultraviolet light visible light, infrared light, or microwave energy, among others, and is transmitted, at least partially, to detector 44. Detector 44 may be configured to receive the electromagnetic energy and detect an alteration in a property of the electromagnetic energy, such as, in the case where the electromagnetic energy includes light, a change in the light's intensity, frequency, polarization, and/or position, among others. The source of energy and the detected alteration may be selected so that passage of an ink droplet between emitter 42 and detector 44 produces the detected alteration, for example, by scattering, absorption, refraction, and/or fluorescence, among others. As described below, detector 44 may include plural sensor units that are configured to detect, selectively, an alteration in the light transmitted from emitter 42, based on the position of the ink droplet relative to the y-axis.

Detection mechanism 20 may be movable along the y-axis, relative to the printhead (and nozzle arrays). For example, in device 10, detection mechanism 20 is mounted on service station 26, so that movement of the detection mechanism is coupled to movement of the service station. Here, detection mechanism 20 is mounted in front of wiper mechanism 38. However, detection mechanism 20 may have any suitable position relative to other mechanisms and/or structures of service station 26, including positions behind the wiper mechanism, lateral to the wiper mechanism (either more centrally or laterally disposed within or outside device 10), and so on. Alternatively, or in addition, detection mechanism 20 may be movably mounted on the service station, so that the detection mechanism can reciprocate independently of the service station. In other embodiments, detection mechanism 20 may be mounted on a separate sled that reciprocates along the y-axis. This reciprocation may be fully uncoupled from movement of the service station, generally along a path that is adjacent to that followed by the service station.

The position of detection mechanism 20 along the y-axis may be known accurately relative to device 10, so that detected droplet trajectories may be related to the position of the detection mechanism. Generally, the position of service station 26, an independent sled, or mechanism 20 itself, may be measured within device 10 or determined mechanically. For example, when detection mechanism 20 is fixedly positioned relative to service station 26 (or an independent sled), the position of the service station (and thus mechanism 20) may be measured by a distance-measuring device, such as an optical or acoustic system. Alternatively, the position of service station 26 (or the sled) may be defined by mechanical control, such as a set of gears that position the service station accurately and controllably. However, in alternative embodiments described below, the position of mechanism 20 along the y-axis may not be known accurately relative to device 10.

Detection mechanism 20 may be mounted on or above a waste reservoir 46. Reservoir 46 may function as a spittoon, to collect ink droplets during printhead nozzle cleaning operations and/or to collect ink droplets whose trajectories are being measured. Here, reservoir 46 is shown mounted on wiper mechanism 38, and supporting emitter 42 and detector 44. However, in alternative embodiments, reservoir 46 may be provided by any suitable vessel carried by (or positioned under) service station 26, or carried by an independent sled.

Figure 3:
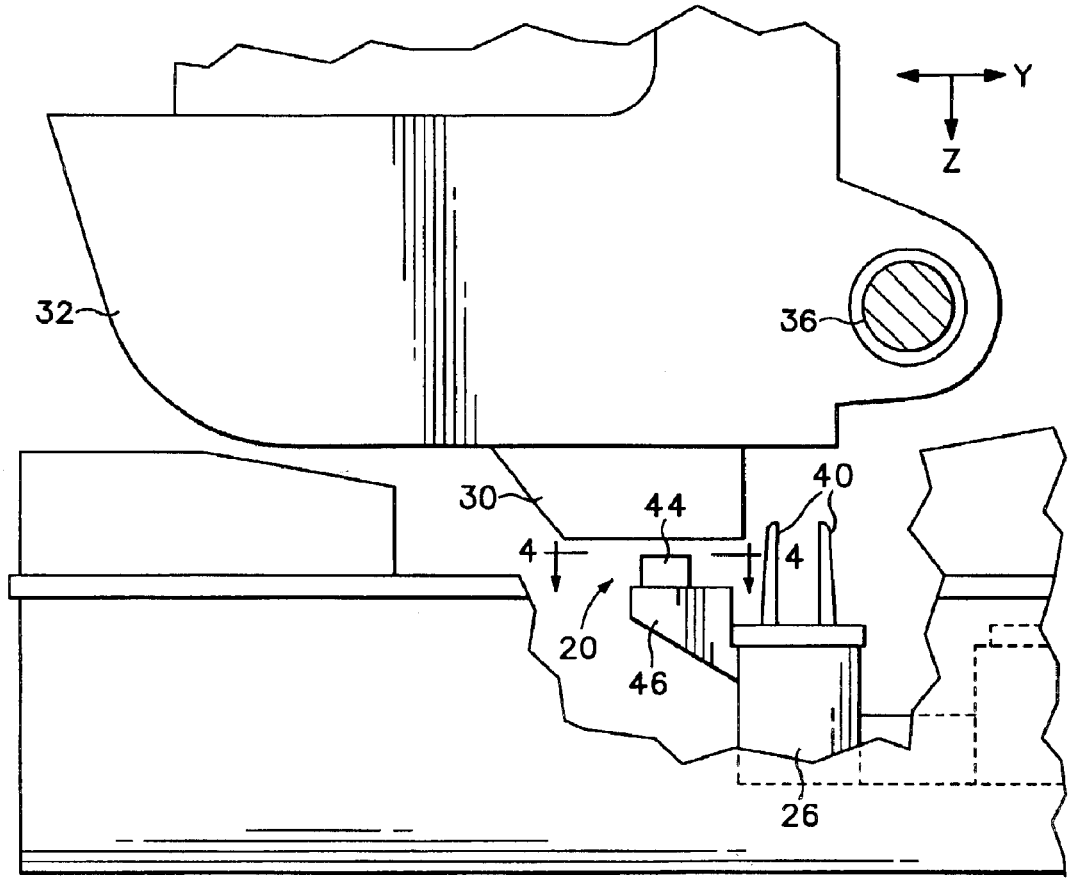
FIG. 3 is side elevation view of selected portions of the printing device of FIG. 1, with a region of the cover removed to reveal the service station and detection mechanism.

FIG. 3 shows a side elevation view of how detection mechanism 20 may be disposed relative to a printhead 30.

Printhead 30 fires ink droplets downward through a trajectory region, and generally along the z-axis, between detector 44 (and emitter 42), when mechanism 20 is appropriately positioned along the y-axis. Here, detector 44 (and emitter 42) are shown somewhat spaced from the printhead along the z-axis. Deviations from an expected trajectory become magnified at positions farther away from printhead 30, but may become more difficult to measure, for example, falling outside the range of detector 44. Accordingly, this vertical spacing may be adjusted to measure trajectories at any suitable or relevant distance, such as a distance approximately equal to the distance between the printhead and print media during printing. Horizontal position may be determined at least partially by the effective detection length of detection mechanism 20, measured along the y-axis. For example, the detection mechanism may have a detection length that is less than the length of a nozzle array on printhead 30 (see FIG. 4). Accordingly, detection mechanism 20 may measure droplet trajectories while another service station mechanism, such as wiper mechanism 38, operates on another portion of the same printhead. Alternatively, detection mechanism 20 may be spaced from other service station mechanisms, so that these mechanisms may be implemented independently. In some embodiments, implementation or one or more service station mechanisms may be at least partially contingent upon measurements obtained with detection mechanism 20.

Figure 4:
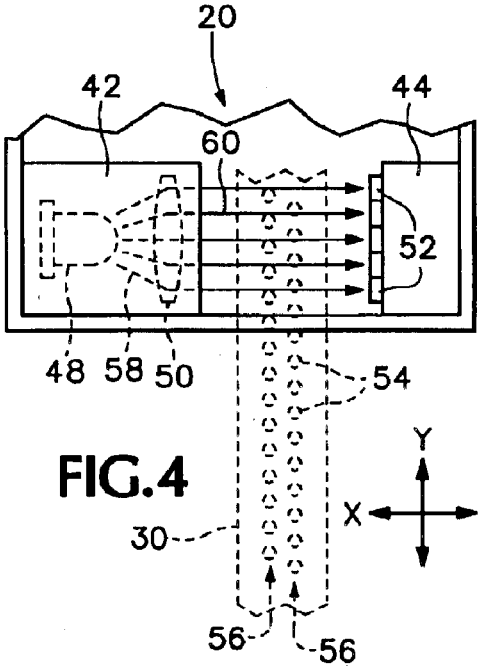
FIG. 4 is a top plan view of the detection mechanism of FIG. 1, viewed generally along 4—4 of FIG. 3.

FIG. 4 shows a top view of detection mechanism 20 in operation below a printhead 30. As indicated, mechanism 20 may include a light source 48, a lens 50, and a set of sensor units 52. Mechanism 20 also generally is connected to an electrical control circuit (not shown). The control circuit may power the light source and may receive electrical signals from sensor units 52. The control circuit may interpret the electrical signals received by detector 44, optionally in conjunction with additional information, such as the position of the detection mechanism relative to device 10, to measure the position of ink droplets. The measured position may be sent to a controller or processor of the printer. Alternatively, the electrical signals received by detector 44 may be sent to the controller or processor directly for further processing.

Printhead 30, shown in phantom outline, is positioned above emitter 42 and detector 44, so that ink droplets selectively fired from nozzles 54 travel downward along the z-axis (into the page in this view), past mechanism 20. In this schematic representation, printhead 30 includes staggered, linear arrays 56 of nozzles 54, typically disposed parallel to the y-axis. Each array may have any suitable number of nozzles, such as 150, 300, 600, or so on, and may have any suitable length. In an exemplary embodiment, printhead 30 has two linear arrays of 300 nozzles each, with an array length of 1-inch, to yield a combined droplet density of about 600 droplets per inch.

Figure 5:
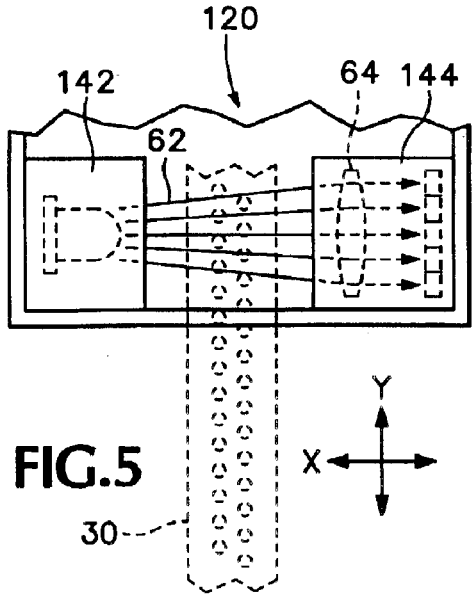
FIG. 5 is a top plan view of an alternative embodiment of the detection mechanism of FIG. 4.

Emitter 42 may transmit light past (below) printhead 30 as follows. Emitter 42 includes a light source 48 emitting diffuse light 58. Light source 48 may be a light-emitting diode, a light bulb, or any other suitable light source that emits diffuse light. Alternatively, light source 48 may be a laser, such as a laser diode, that emits parallel light rays. Here, light 58 travels through lens 50 to be focused into parallel rays 60 of collimated light. Rays 60 travel below printhead 30, through expected trajectories of a subset of ink droplets fired from printhead 30. FIG. 5 shows an alternative embodiment of a detection mechanism 120, in which diffuse light 62 travels past printhead 30. Here, the shadow created by the ink drop is imaged on the detector by lens 64 that is adjacent to, or within, detector 144.

FIG. 4 shows how detector 44 may receive light transmitted from emitter 42. The detector may include an array, generally a linear array, of individual sensor units 52. The linear array may be at least substantially aligned with the y-axis or extend obliquely relative to the y-axis (see FIG. 7). In either arrangement, sensor units 52 are arrayed to distinct positions along the y-axis, allowing in-flight detection of droplet trajectories at these distinct positions. Accordingly, sensor units 52 may be configured to independently sense interruptions or alterations in distinct regions of the collimated light that is transmitted past printhead 30, through a trajectory region of fired ink droplets. For example, as shown here, each detector unit may be configured to detect a discrete segment or portion of light following a path, relative to the entire width of the light, as measured along the y-axis. In some embodiments, the sensor unit array may be a two-dimensional array, for example, two linear arrays spaced from each other along the z-axis. Such a two-dimensional array may provide an error checking function or may provide more accurate information about droplet trajectories.

Sensor units 52 of detector 44 may be individual photosensors assembled in an array. For example, the photosensors may be individual photodiodes that are linearly arrayed to define a closely spaced set of "pixels" using conventional technology. To reduce the expense of such photosensor arrays, the length of the array may be substantially less than the length of nozzle array 56. For example, FIG. 4 shows that movement of detection mechanism 20 along the y-axis is used to detect droplets fired from portions of nozzle arrays 56 that flank the detected portion. Accordingly, the detection mechanism may be movable to plural droplet-detecting positions along the y-axis, each of which allows detection of less than all of the fired ink droplets.

Figure 6:
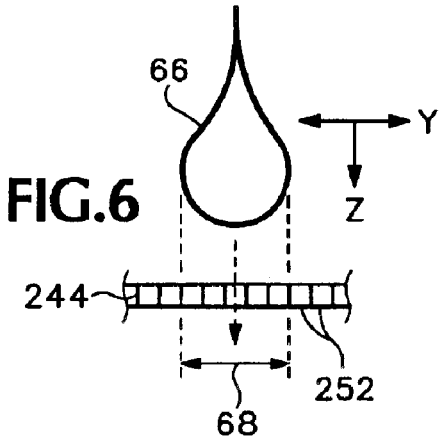
FIG. 6 is a somewhat schematic side view of a droplet traveling along a trajectory that is detectable by an array of sensor units, each unit having a width less than the diameter of the droplet, in accordance with an embodiment of the present invention.

Each sensor unit may have any suitable width relative to the average diameter of an ink droplet. FIGS. 4 and 5 show sensor units with a width (and center-to-center spacing) approximately equal to the spacing of nozzles and thus the average diameter of an ink droplet. By contrast, FIG. 6 shows an alternative configuration of a detector 244. In this configuration, an average droplet 66, fired from each of nozzles 54 (not shown here), has a diameter 68 substantially greater than the width of each sensor unit 252. Here, light transmitted to a block of five sensor units is affected by passage of droplet 66 in front of sensor units 252. Accordingly the sensor unit centrally disposed within this affected block measures a central position of droplet 66. In addition, the number of sensor units affected by droplet 66 may provide information about droplet size or volume. In one exemplary embodiment, each sensor unit has a width of about 8 $\mu$m and an ink droplet has a diameter of about 40 $\mu$m.

Figure 7:
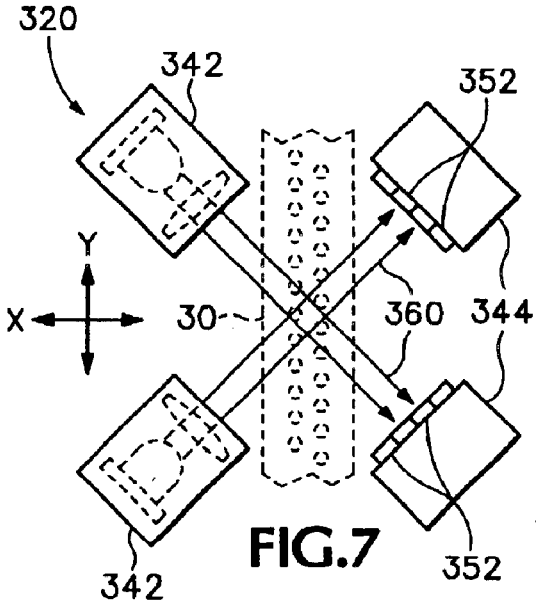
FIG. 7 is a top plan view of another embodiment of the detection mechanism of FIG. 4.

FIG. 7 shows a detection mechanism 320 that may be used to obtain information about the trajectory of droplets along both the y- and x-axes. Mechanism 320 includes two emitter-detector pairs 342, 344, which are disposed at an angle, typically orthogonally, relative to each other. The emitter-detector pairs may be disposed within a plane disposed generally orthogonal to the z-axis, or may be disposed in a plane oriented obliquely to the z-axis. Light rays 360 from each of two light sources in emitter 342 are transmitted along nonparallel paths. These paths may intersect within a droplet trajectory region below printhead 30 to provide concurrent detection by each detector 344 of each droplet fired through the region. This concurrent detection allows determination of droplet position within each set of sensor units 352 and thus triangulation to a trajectory point (relative to both the x- and y-axes) within the region. In alternative embodiments, nonparallel light rays 360 may intersect outside of the trajectory region. Accordingly, in these embodiments, detectors 344 do not unambiguously position a droplet concurrently, but instead may partially position distinct droplets at the same time. The detection mechanism 320 then may be moved along the y-axis to measure droplet position with the other detector 344 for each droplet to provide unambiguous positioning within the x-y plane.

Figure 8:
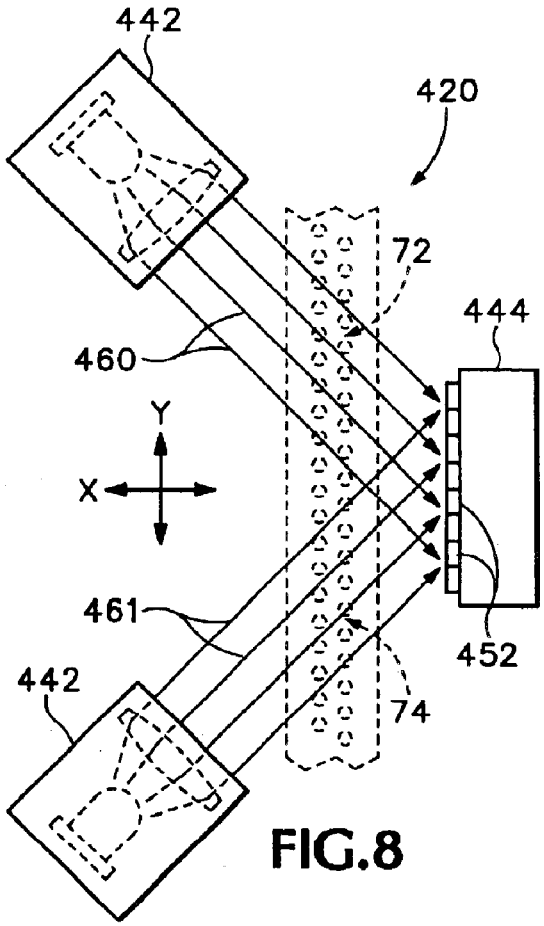
FIG. 8 is top plan view of yet another embodiment of the detection mechanism of FIG. 4.

FIG. 8 shows another embodiment of a detection mechanism 420 for measuring in-flight positions of droplets within the x-y plane. In mechanism 420, emitters 442 may be oriented at an angle to each other, for example, orthogonally. Accordingly, distinct light rays 460, 461 from emitter 442 follow nonparallel paths, passing through a droplet trajectory region, generally parallel to the x-y plane. However, in contrast to mechanism 320, a single detector 444 may be used to detect light transmitted from each of emitters 442. Shared detector 444 may include sensor units 452 arrayed generally parallel to the y-axis, and positioned so that ink droplets fired from spaced sets 72, 74 of nozzles may be detected by the same sensor units 462. Accordingly, a droplet may be positioned by sequentially altering each of light rays 460, 461, by firing two ink droplets from the same nozzle at two distinct positions of mechanism 420 along the y-axis. Each detector 444 provides partial positioning information about the droplet that may be combined to produce a defined position in the x-y plane. To reduce background noise, only one of the two emitters may be active, that is, transmitting light, during detection of ink droplets fired from a corresponding one of spaced sets 72, 74.

Figure 9:
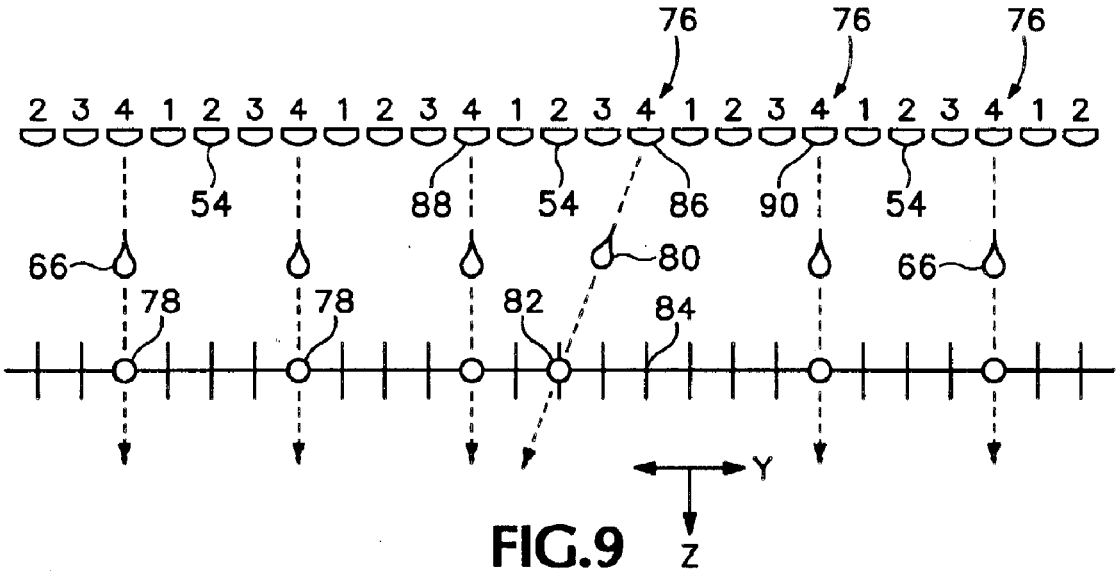
FIG. 9 is a schematic view illustrating implementation of a method for measuring relative trajectories of ink droplets fired from a spaced set of nozzles.

FIG. 9 illustrates results that may be obtained using a method for determining relative positions of ink droplets. The method may be suitable for droplet detection mechanisms, as described herein, that are movable but cannot easily be accurately positioned relative to printing device 10.

First, the detection mechanism is positioned in a droplet-detecting position relative to the printhead. Such positioning may be achieved, for example, by repeatedly firing a nozzle (or set of nozzles), while moving the detection mechanism, until the detector detects a droplet. Alternatively, or in addition, the positioning may be achieved by sequentially firing nozzles distributed in a spaced relation across a nozzle array until a signal is detected, while moving the detection mechanism when necessary. Furthermore, positioning of the detection mechanism may be facilitated by an approximate positioning mechanism (not shown) that is configured to move the detection mechanism to an approximate position relative to the printhead along the y-axis.

Next, a selected set (or sets) of ink droplets is fired from a corresponding set of nozzles having a known spacing within a nozzle array. Ink droplets that are fired along expected trajectories have a spacing corresponding to the known spacing. Deviations from expected trajectories produce detected in-flight positions that are aberrant.

The ink droplets are fired through a trajectory region detectable by the detection mechanism. Each droplet of the selected set is detectable if it produces an alteration in detected light. Accordingly, in-flight droplet positions, along the y-axis or relative to the xy-plane, are detected for the selected set as alterations in light. The selected set may be fired at least substantially at the same time (concurrently), to speed the measurement, or the set may be fired individually or as distinct subsets, to minimize ambiguous measurements. A concurrently fired set (or subset) may be regularly or irregularly spaced, based on the known spacing of the nozzle array, and may have a spacing that is sufficient to minimize misinterpretation of positions.

FIG. 9 illustrates firing a selected set of ink droplets 66 from a regularly spaced set 76 of nozzles 54 and measuring relative trajectory positions 78 of the droplets 66 along the y-axis. Here, an ink droplet has been fired from every fourth nozzle, as indicated by the numbering scheme at the top. However, a lesser or greater spacing of nozzles may be selected based, for example, on an average (or median, maximal, etc.) distance by which a droplet strays from its intended course, and a number of additional droplet firings from a given nozzle that are to be conducted to confirm relative positions.

In alternative embodiments of the method, a position of the detection mechanism and/or detector may be known, along the y-axis, relative to the printing device. In these embodiments, detected in-flight positions of each ink droplet may be related to the known position of the detector.

Relative positions 78 of droplets 66 are compared with expected relative positions, based on the known spacing of nozzles from which ink droplets were fired. For example, errant droplet 80 is positioned aberrantly, shown at 82, from its predicted spaced position 84. To confirm that errant droplet 80 followed an incorrect trajectory, additional sets of nozzles may be fired. For example, a distinct set that includes potentially malfunctioning nozzle 86, and another distinct set that includes one or both flanking nozzles 88, 90. With a clogged nozzle or a nozzle that fires droplets outside of the range of detection, no in-flight position of a fired ink droplet is measured (not shown).

It is believed that the disclosure set forth above encompasses multiple distinct embodiments of the invention. While each of these embodiments has been disclosed, the specific embodiments thereof as disclosed and illustrated herein are not to be considered in a limiting sense as numerous variations are possible. The subject matter of this disclosure thus includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

What is claimed is:

1. A printing device, comprising:

an ink delivery system configured to selectively fire ink droplets from an array of nozzles onto media, the array being disposed substantially parallel to an axis; and a detection mechanism configured to detect in-flight positions of the ink droplets along the axis and configured to move substantially parallel to the axis and relative to the array of nozzles.

2. The printing device of claim 1, further comprising a service station for servicing at least one aspect of the ink delivery system, movement of the detection mechanism being coupled to movement of the service station.

3. The printing device of claim 1, further comprising a media positioning mechanism configured to move the media substantially parallel to the axis.

4. The printing device of claim 1, wherein the axis is a first axis, and at least a portion of the ink delivery system is movable substantially parallel to a second axis, and wherein the first and second axes are at least substantially orthogonal.

5. The printing device of claim 1, wherein the detection mechanism is movable to plural droplet-detection positions along a path substantially parallel to the axis and is configured to detect less than all of the fired ink droplets at each of the plural droplet-detection positions.

6. A printing device, comprising:

an ink delivery system configured to selectively fire ink droplets from an array of nozzles onto media, the array being disposed substantially parallel to an axis; and a detection mechanism configured to detect in-flight positions of the ink droplets along the axis, wherein the detection mechanism includes an optical detector, the optical detector having plural sensor units disposed at distinct positions relative to the axis.

7. The printing device of claim 6, wherein the axis is a first axis, and the detection mechanism also configured to detect the in-fight positions relative to a second axis that is at least substantially orthogonal to the first axis.

8. A printing device, comprising:

an ink delivery system configured to selectively fire ink droplets from an array of nozzles onto media, the array being disposed substantially parallel to an axis; and a detection mechanism configured to detect in-flight positions of the ink droplets along the axis, the detection mechanism including a light source that transmits light to a detector, the light being at least substantially collimated as it reaches the detector.

9. The printing device of claim 8, the detection mechanism being configured to detect an alteration of light produced by one of the ink droplets passing through a portion of a path followed by the light, the portion being within a trajectory region through which the ink droplets are fired.

10. A printing device, comprising:

an ink delivery system configured to selectively fire ink droplets from an array of nozzles onto media, the array being disposed substantially parallel to an axis; and a detection mechanism configured to detect in-flight positions of the ink droplets along the axis, wherein the detection mechanism includes plural light sources, the plural light sources being configured to transmit light along nonparallel paths to a detector, and wherein the detector is shared by the plural light sources.

11. A printing device, comprising:

an ink delivery system configured to selectively fire ink droplets from an array of nozzles onto media, the array being disposed substantially parallel to an axis; and a detection mechanism configured to detect in-flight positions of the ink droplets along the axis, wherein the detection mechanism includes plural light sources, the plural light sources being configured to transmit light along nonparallel paths to corresponding plural detectors.

12. A printing device, comprising:

an ink delivery system configured to selectively fire ink droplets from an array of nozzles onto media, the array being disposed substantially parallel to an axis;

a detection mechanism configured to detect in-flight positions of the ink droplets along the axis; and wherein the printing device is configured to relate the in-flight positions to at least one position of the detection mechanism, wherein the axis is a first axis, and wherein the at least one position of the detection mechanism is defined relative to the printing device and a second axis substantially parallel to the first axis.

13. A printing device, comprising:

an ink delivery system configured to selectively fire ink droplets from nozzles that reciprocate transverse to an axis, each fired ink droplet having an in-flight position along a line substantially parallel to the axis; and an optical detection mechanism including a detector having plural sensor units disposed along the axis and configured to detect the in-flight position with a subset of the plural sensor units.

14. The printing device of claim 13, wherein the nozzles include a linear array of nozzles, and wherein the detection mechanism is movable relative to the array, to plural droplet-detecting positions along the axis, and is configured to detect the in-flight position for less than all of the fired ink droplets at each of the plural droplet-detecting positions.

15. The printing device of claim 13, further comprising a service station for servicing at least one aspect of the ink delivery system, movement of the detection mechanism being coupled to movement of the service station.

16. The printing device of claim 15, the movement of the service station being at least substantially parallel to the axis.

17. The printing device of claim 13, further comprising a media positioning mechanism configured to move print media at least substantially parallel to the axis.

18. The printing device of claim 13, wherein the detection mechanism includes plural light sources, the plural light sources being configured to transmit light along nonparallel paths to the detector, and wherein the detector is shared by the plural light sources.

19. The printing device of claim 13, wherein the detection mechanism includes plural light sources, the plural light sources being configured to transmit light along nonparallel paths to corresponding plural detectors.

20. The printing device of claim 13, wherein the axis is a first axis, and the detection mechanism also is configured to detect the in-flight position of fired ink droplets along lines that are substantially parallel to a second axis, the second axis being substantially orthogonal to the first axis.

21. The printing device of claim 13, wherein the printing device is configured to relate the in-flight position to at least one position of the detection mechanism defined relative to the printing device and along the line substantially parallel to the axis.

22. The printing device of claim 13, wherein the printing device is configured to relate plural of the in-flight positions to each other.

23. A device for measuring in-flight trajectories of ink droplets in an inkjet printing device, comprising:

an optical detector having plural sensor units, each sensor unit being configured to detect an alteration in light produced by an ink droplet passing through a portion of a path followed by such light, the plural sensor units being configured to be disposed at distinct positions generally along an axis; and an emitter configured to transmit light to the plural sensor units along the path and across a trajectory region of an ink delivery system, the ink delivery system having an array of nozzles for selectively firing ink droplets onto print media, the array being disposed generally parallel to the axis.

24. The measuring device of claim 23, wherein the alteration is detected by less than all of the plural sensor units.

25. The measuring device of claim 23, wherein the detector is configured to be movable to plural droplet-detecting positions along the axis and is configured to detect less than all of the fired ink droplets at each of the plural droplet-detecting positions.

26. The measuring device of claim 25, wherein the detector is configured to be movable by coupling to movement of a service station of the inkjet printing device.

27. The measuring device of claim 23, wherein the axis is at least substantially parallel to a media-positioning axis along which the print media is moved.

28. The measuring device of claim 23, wherein the axis is a first axis, and the array of nozzles is movable generally along a second axis that is at least substantially orthogonal to the first axis.

29. A method for measuring trajectories of ink droplets fired by an inkjet printing device, the method comprising:

transmitting electromagnetic energy;

firing a selected set of the ink droplets from a printhead in a stationary configuration, each droplet of the selected set producing an alteration in the electromagnetic energy when fired generally along a predicted trajectory; and detecting the alteration, if any, for each droplet of the selected set to provide in-flight positions, wherein detecting the alteration is via a detection mechanism configured to detect in-flight positions of fired ink droplets relative an axis, the detection mechanism being movable to plural droplet-detecting positions along a line that is generally parallel to the axis, and wherein the detection mechanism is configured to detect less than all of the fired ink droplets at each of the droplet-detecting positions.

30. The method of claim 29, wherein transmitting electromagnetic energy is via plural emitters configured to transmit the electromagnetic energy to the detection mechanism along nonparallel paths, and wherein firing includes expelling two ink droplets from a specific nozzle when the detection mechanism is disposed at each of at least two distinct positions along the axis, so that each the two ink droplets produces an alteration in a distinct one of the nonparallel paths.

31. The method of claim 29, wherein the selected set of ink droplets is fired from a corresponding set of the nozzles having known spacing within an array of nozzles disposed generally parallel to the axis, and wherein the method further comprises comparing the in-flight positions of the detected alterations with the known spacing of the set of nozzles to identify an errant member of the selected set.

32. The method of claim 29, further comprising relating the in-flight positions of the selected set to at least one position of the detection mechanism relative to the printing device.

33. A method for measuring trajectories of ink droplets fired by an inkjet printing device, the method comprising:

transmitting electromagnetic energy;

firing a selected set of the ink droplets from a printhead in a stationary configuration, each droplet of the selected set producing an alteration in the electromagnetic energy when fired generally along a predicted trajectory;

detecting the alteration, if any, for each droplet of the selected set to provide in-flight positions; and wherein the selected set is fired at least substantially at the same time.

34. A method for measuring trajectories of ink droplets fired by an inkjet printing device, the method comprising:

transmitting electromagnetic energy;

firing a selected set of the ink droplets from a printhead in a stationary configuration, each droplet of the selected set producing an alteration in the electromagnetic energy when fired generally along a predicted trajectory;

detecting the alteration, if any, for each droplet of the selected set to provide in-flight positions; and performing a maintenance operation on the ink delivery system based on the detected alterations, the maintenance operation being conducted by a service station of the printing device.

35. A method for measuring trajectories of ink droplets fired by an inkjet printing device, the method comprising:

transmitting electromagnetic energy;

firing a selected set of the ink droplets from a printhead in a stationary configuration, each droplet of the selected set producing an alteration in the electromagnetic energy when fired generally along a predicted trajectory;

detecting the alteration, if any, for each droplet of the selected set to provide in-flight positions; and wherein the stationary configuration is disposed in a service station, which further comprises moving the printhead away from the service station.

* * * * *